US005885113A

United States Patent [19]

Bricaud

[11] Patent Number: 5,885,113

[45] Date of Patent: Mar. 23, 1999

[54] CONNECTOR WITH RETAINED CONTACTS

[75] Inventor: Herve' Guy Bricaud, Dole, France

[73] Assignee: ITT Manufacturing Enterprises, Inc., Wilmington, Del.

[21] Appl. No.: 780,980

[22] Filed: Jan. 9, 1997

[30] Foreign Application Priority Data

May 11, 1995 [FR] France ..... 95 05565
May 3, 1996 [WO] WIPO ..... PCT/FR96/00679

[51] Int. Cl.[6] ..... H01R 13/40

[52] U.S. Cl. ..... 439/733.1

[58] Field of Search ..... 439/587, 689, 439/752, 688, 274, 744, 733.1, 869, 871

[56] References Cited

U.S. PATENT DOCUMENTS

| | | | |
|---|---|---|---|
| Re. 33,005 | 8/1989 | Bryce . | |
| 2,704,357 | 3/1955 | Johnson . | |
| 2,918,521 | 12/1959 | Abrams . | |
| 3,095,470 | 6/1963 | Dozier . | |
| 3,244,801 | 4/1966 | Dozier . | |
| 3,267,205 | 8/1966 | Dozier . | |
| 3,349,365 | 10/1967 | Dozier . | |
| 3,671,920 | 6/1972 | Iantorno . | |
| 3,897,131 | 7/1975 | Stauffer . | |
| 4,619,496 | 10/1986 | Forney, Jr. . | |
| 4,799,904 | 1/1989 | Sutcliffe . | |
| 4,822,288 | 4/1989 | Conley . | |
| 4,936,012 | 6/1990 | Shepherd . | |
| 4,941,847 | 7/1990 | Welsh | 439/595 |
| 4,964,805 | 10/1990 | Gabany . | |
| 5,030,134 | 7/1991 | Plosser . | |
| 5,035,656 | 7/1991 | Patel . | |
| 5,122,078 | 6/1992 | Davis et al. . | |
| 5,147,227 | 9/1992 | Yurko | 439/733.1 |
| 5,158,479 | 10/1992 | Mouissie . | |
| 5,263,880 | 11/1993 | Schwarz et al. | 439/733.1 |
| 5,286,218 | 2/1994 | Sakurai . | |
| 5,346,413 | 9/1994 | Leon . | |
| 5,458,510 | 10/1995 | Nager, Jr. et al. | 439/733.1 |
| 5,460,549 | 10/1995 | Muzslay . | |

*Primary Examiner*—Khiem Nguyen
*Attorney, Agent, or Firm*—Thomas L. Peterson

[57] ABSTRACT

A connector is described, of the type that has an insulator (16) with passages (22) that hold contacts (24), in which the contacts can be installed by pressing them into the passages, wherein the passages and contacts are formed to more securely hold the contacts in place. Each passage has a narrowed passage section (36) with front and rear ends, and each contact has a forward part (48) with a contact shoulder (52) that abuts a shoulder (42) at the front of the passage section. Mid and rear flanges (54, 46) lie behind the contact front part and in interference fit with the narrowed passage section, with the rear flange having a smaller outside diameter than the mid flange. The rear end of the passage has a short tapered part (64) that is engaged by the rear flange. The mid flange has anti-rotation notches (58), with cylindrical peripheral parts (70) lying between the notches.

9 Claims, 3 Drawing Sheets

CONNECTOR WITH RETAINED CONTACTS

CROSS-REFERENCE

This application claims priority of International Application PCT/FR 96/00679 which was filed on May 3, 1996 and which designated the United States, and which claimed priority from France No. 95 05565 filed May 11, 1995.

BACKGROUND OF THE INVENTION

One type of connector has contacts that are installed by pressing them rearwardly into passages of a plastic insulator. Each contact has a flange with a tapered rear surface and a forwardly-facing front surface, to retain the contact in the passage. Some connectors of this type have insulators of predetermined specifications with only moderate variations allowed, and contacts for them must be designed for maximum retention against pullout as well as resistance to tilt or turning in such passages. Contacts of the above type which provide high retention capacity as well as resistance to tilt and turning, and a connector insulator which facilitated connector holding with only minor changes from a predetermined insulator size, would be of value.

SUMMARY OF THE INVENTION

In accordance with one embodiment of the present invention, a connector is provided of the type that includes contacts installed in cylindrical passages by forcing them rearwardly into place, wherein the contacts are highly resistant to movement from their installed positions. Each contact has a forward part that abuts a shoulder at the front of a narrowed passage section, and has mid and rear flanges that lie in the narrowed passage section in interference fit therewith. The rear flange has a smaller diameter than the mid flange.

The rear of the narrowed passage section forms a tapered passage part. The rear flange engages the tapered part. The mid flange has a plurality of notches to prevent rotation, and has cylindrical peripheral part between the notches.

The novel features of the invention are set forth with particularity in the appended claims. The invention will be best understood from the following description when read in conjunction with the accompanying drawings.

DESCRIPTION OF THE PREFERRED EMBODIMENT

Figure 1:
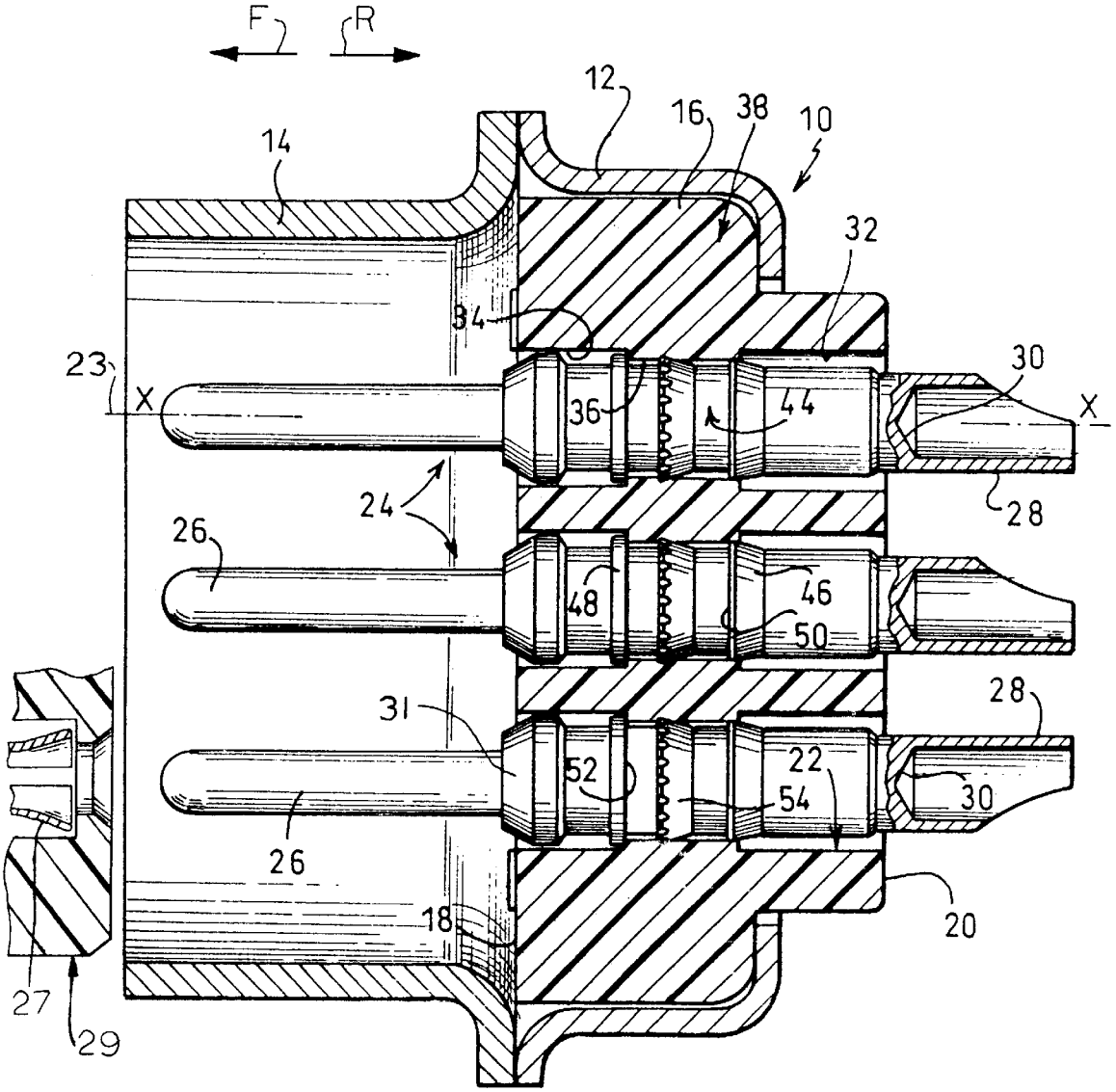
FIG. 1 is a sectional view of an electrical connector constructed in accordance with the present invention.

FIG. 1 shows an electrical connector 10 of the present invention, which includes a metal shell formed by two shell parts 12, 14 and an insulator 16 formed of injection molded engineering plastic that lies in the shell. The insulator has front and rear faces 18, 20 and has a plurality of through passages 22, with each passage having an axis 23 extending in forward and rearward directions F, R. The connector includes a plurality of electrical contacts 24 that each lies in one of the passages. The figures show male contacts with pin-shaped front ends 26 for mating with socket contacts 27 of a mating second connector 29. Of course, the particular contacts 24 can be formed with socket contact ends. The rear end 28 of each contact is constructed to connect to a conductor, such as a wire which can fit into a cavity 30 and be crimped or soldered in place.

Each passage has a narrowed passage section 36 and rear and front sections 32, 34. Each contact has a central part 44 that lies in the passage, with each central part including a forward part 48 in the form of a forward flange, a rear flange 46, and a mid flange 54. These three flanges serve to retain and stabilize the position of each contact within a corresponding passage 36. An additional flange-like positioner 31 which lies in the passage forward section 34, helps to avoid tilt of the connector.

Figure 4:
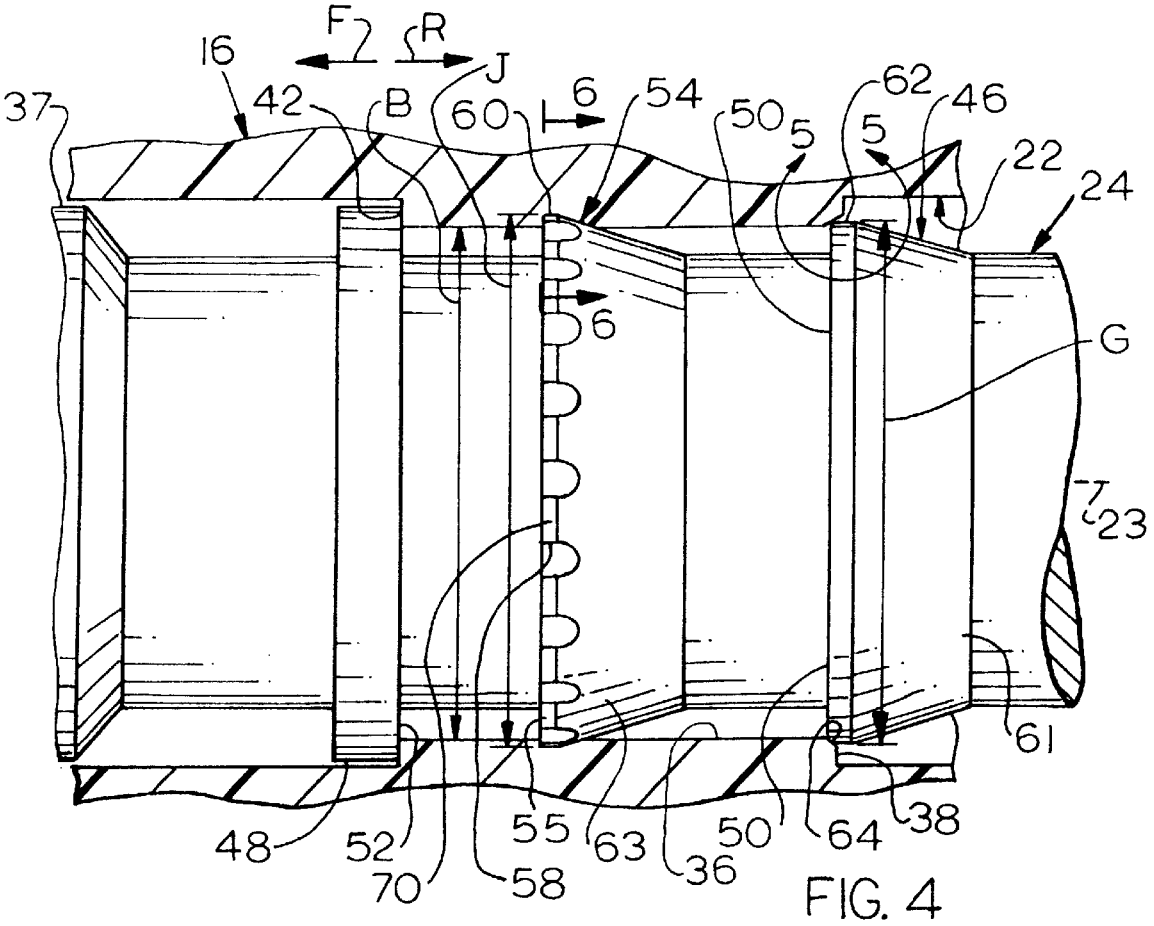
FIG. 4 is a view showing the contact portion of FIG. 2 lying within the passage portion of FIG. 3.

As shown in FIG. 4, the passage forms a forwardly-facing passage shoulder 42 at the front end of the narrowed passage section 36. The forward part or forward flange 48 of the contact has a rearwardly-facing shoulder 52 that abuts the passage shoulder 42, to prevent rearward R movement of the contact. The passage has a largely rearwardly-facing rearward shoulder or wall 38, and the rear flange 46 has a forwardly-facing shoulder 50 that abuts the rear wall 38. The abutment of the shoulder 50 with the rear wall 38, helps to prevent the contact from moving forwardly F during unmating of the connectors. A mid flange 54 which lies between the front and rear flanges 48, 46, has a forwardly-facing shoulder 55 that is imbedded in the insulator at its narrowed passage section 36. The shoulder 55 also helps to prevent forward movement of the connector out of the passage.

The mid flange 54 has a cylindrical front portion 60 of a large diameter J which is considerably larger than the inside diameter B of the cylindrical passage section 36. As a result, there is a large interference fit between them, which results in large resistance to forward pullout of the mid flange 54. The rear flange 46 has a cylindrical peripheral surface or portion 62 which has an outside diameter G which is also larger than the inside diameter B of the narrowed passage section 36. However, the diameter G of the rear flange is less than the diameter J of the mid flange. As a result, during rearward contact movement to install the contact in the passage, the rear flange 46 helps to "prepare" the plastic material of the insulator for the larger diameter mid flange 54, which reduces trauma and harm to the part of the narrowed passage section which lies forward of the mid flange 54. The rear and mid flanges each have tapered rear ends 61, 63 that are angled about 15° to the axis to facilitate contact installation.

Figure 5:
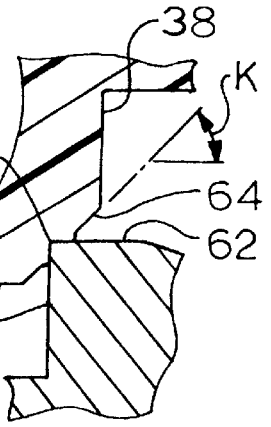
FIG. 5 is an enlarged view of the area 5—5 of FIG. 4.

The rearwardly-facing wall 38 at the rear end of the narrowed passage section 36, includes a chamfered or tapered part 64 at the radially inward part of the wall (the part closest to the axis 23). As shown in FIG. 5, the intersection of the contact shoulder 50 and the contact peripheral surface 62 is a sharp corner 66 that lies in interference fit with the tapered part 64, and which digs into the tapered part. The corner 66 is sharp in that its radius of curvature is less than one percent of the diameter G of the flange at the shoulder. After the engineering plastic material of the insulator 16 has somewhat recovered from its deflection by the rear flange 46, the corner 66 continues to press into the tapered part 64. The corner 66 provides additional holding power against forward F movement of the contact because the tapered part 64 extends at an angle K of more than 15° to the axial direction, and preferably about 45° thereto. The engagement of the corner 66 with the tapered part 64 also helps to avoid tilt of the contact, since such tilt would cause further digging in of the corner into the part 64. The area of the insulator around the corner 66 can readily "bulge" out around the corner, so the insulator part thereat is unlikely to be damaged, but instead to retain its shape.

Figure 6:
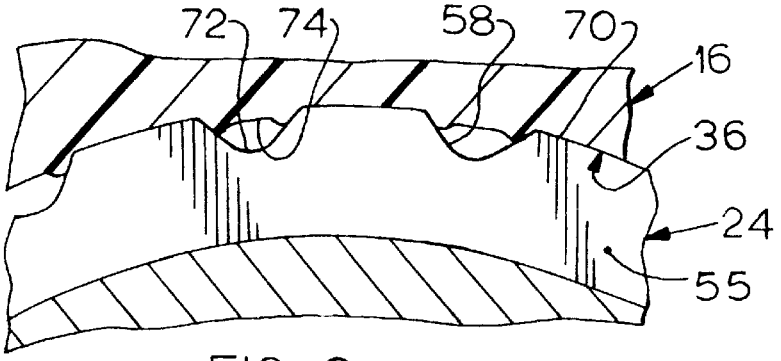
FIG. 6 is a sectional view taken on line 6—6 of FIG. 4.

The cylindrical portion 60 of the mid flange 54 has a plurality of notches 58 which are spaced apart by cylindrical parts 70. The notches resist turning of the contact about the axis 23. As shown in FIG. 6, the notches 58 have centers 72 that lie radially inside the passage walls 74 of the passage section 36. The deep notches reduce the volume of displaced plastic resulting from the interference, which reduces the risk of cracking the plastic insulator 16. In other words, the deep notches allow greater interference at the cylindrical projecting teeth parts 70. The cylindrical parts 70, which constitute over 10% and preferably constitute at least 25% of the periphery of the flange portion 60, serve to center the contact within the narrow passage section 36, as well as providing a shoulder 55 to resist forward movement of the contact. For the contact 24 shown, the cylindrical parts 70 constitute at least 50% of the periphery. There are twenty notches, so the parts 70 are spaced by 18°.

Figure 2:
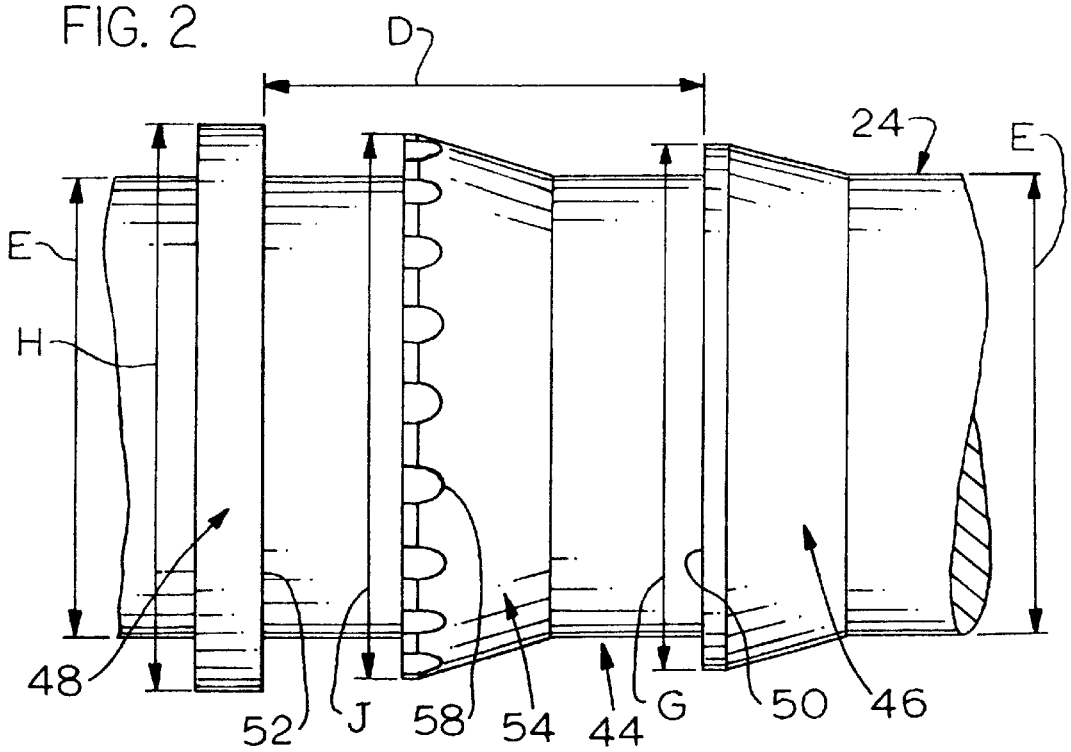
FIG. 2 is an enlarged partial side elevation view of the central part of an electrical contact of FIG. 1.
Figure 3:
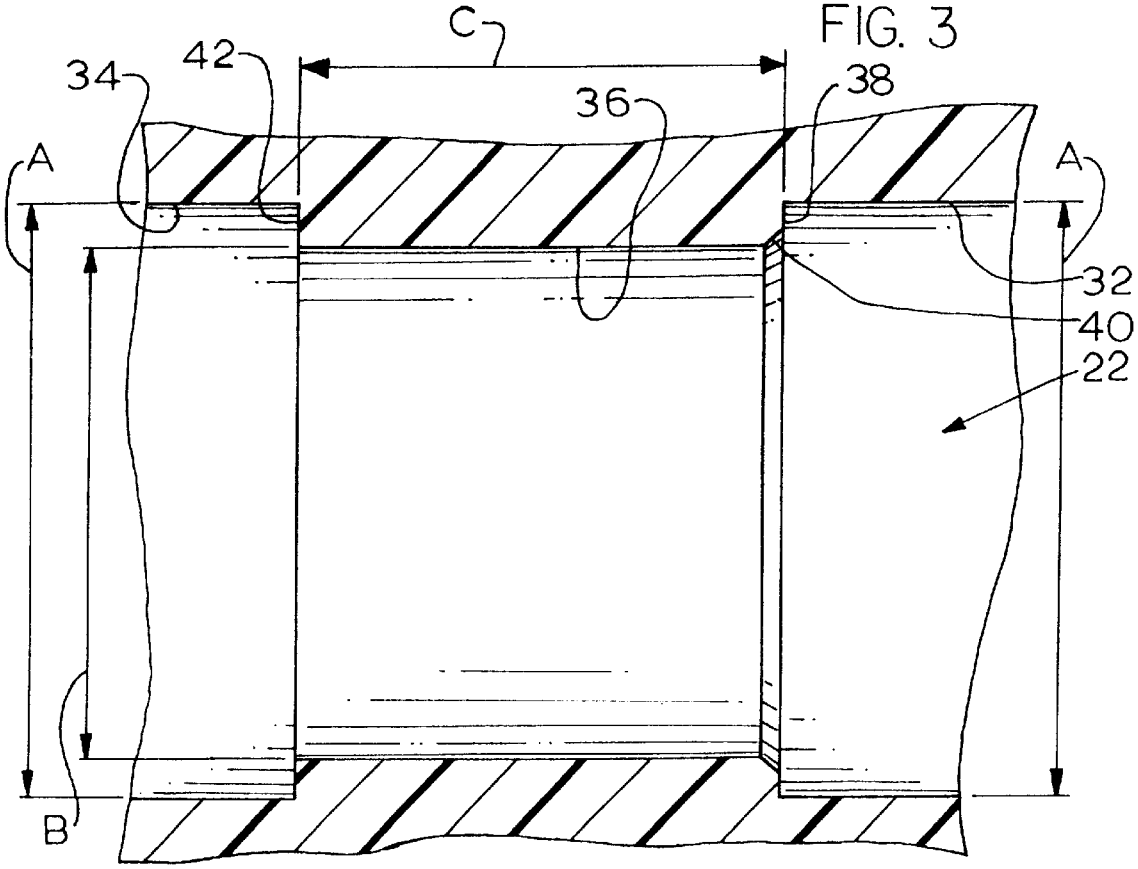
FIG. 3 is an enlarged partial sectional view of a central part of a passage of the connector of FIG. 1.

The various diameters of locations along the passage and along the contact are shown in FIGS. 2 and 3. A is the diameter of the rear and front sections 32, 34 while B is the diameter of the narrowed passage section 36. C is the length of the passage section 36. On the contact, D is the distance between the shoulders 50, 52 on the rear and front flanges. E is the diameter of the central section 44 of the contact, G is the outside diameter of the rear flange 46, H is the outside diameter of the front flange 52, and J is the outside diameter of the mid flange 54. The various diameters satisfy the following conditions:

$H>J\geqq G>E$ $H<A$; $G>B$; $H>B$; $J>B$; and $G>B$

In addition, D is slightly less than C.

In a contact that applicant has designed, the dimensions were as follows: A=2.2 mm, B=1.87 mm, C=1.80 mm, D=1.7 mm, E=1.72 mm, G=1.92 mm, H=2 mm, and J=1.95 mm. With these dimensions, it is possible to obtain an axial retention force greater than forty newtons, and about equal to fifty newtons. The axial retention force is the force required to pull the connector forwardly F out of the passage.

Thus, the invention provides a connector of the type wherein contacts are installed in insulator passages by pushing each contact rearwardly into place, which results in reliable positioning of the contacts and in a large retention force that resists forward movement of each contact out of its passage. Each contact has two flanges lying in interference fit with the passage, with the rearmost flange being of smaller diameter than the frontmost flange. The rearmost flange preferably has a corner lying at the intersection of its periphery and a forwardly-facing shoulder thereof, which lies against a tapered part of the passage walls at the rear of a narrowed passage section. The mid flange has a periphery with notches therein that resist turning. The periphery of the mid flange is of circular cross section as viewed along the contact axis, and is preferably cylindrical, with circular portions lying between adjacent notches and constituting at least one-quarter of the periphery of the mid flange, to better center the flange in the passage. Each notch preferably has primarily circumferentially-facing ends.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector comprising:

an insulator which has a plurality of cylindrical passages extending in forward and rearward directions, each passage having walls forming a narrowed passage section and a forwardly-facing passage shoulder at a front end of the narrowed passage section;

a plurality of contacts lying in said passages, each contact having a forward part with a rearwardly-facing contact shoulder abutting said passage shoulder, a rear flange that lies rearward of said forward part and that lies in an interference fit with said narrowed passage section, and a mid flange that lies between said front part and said rear flange and that lies in an interference fit with said narrowed passage section;

each of said flanges having a tapered rear portion and a front end forming a forwardly-facing shoulder;

said rear flange has a smaller outside diameter than said mid flange.

2. The connector described in claim 1 wherein:

said passage has an axis and has a rear wall at the rear of said narrowed passage section, with said rear wall having a radially inward part that is tapered to have a progressively larger diameter at progressively more rearward locations;

said rear flange has a forwardly-facing shoulder with a periphery that engages said inward part of said rear wall.

3. The connector described in claim 1 wherein:

one of said flanges has a plurality of notches in its periphery, with said notches being circumferentially spaced about said one of said flanges, and leaving parts of circular shape between adjacent notches.

4. The connector described in claim 3 wherein:

said one of said flanges is said mid flange, and said periphery of said mid flange has cylindrical parts between said notches, with said cylindrical parts occupying at least one-fourth of said periphery.

5. A connector comprising:

an insulator which has a plurality of cylindrical passages extending in forward and rearward directions, each passage having an axis extending in said forward and rearward directions, each passage having a narrowed passage section with front and rear ends, and each passage having a forwardly-facing passage shoulder at said passage section front end and having a rear wall at said passage section rear end;

a plurality of contacts lying in said passages, each contact having a forward part with a rearwardly-facing contact shoulder abutting said forward-facing passage shoulder, and each contact having a rear flange that lies rearward of said forward part;

said rear wall of said passage section has a radially inward part that is tapered to have a progressively larger diameter at progressively more rearward locations;

said rear flange has a forwardly-facing shoulder with a periphery that engages said tapered radially inward part of said rear wall.

6. A connector comprising:

an insulator which has a plurality of cylindrical passages extending in forward and rearward directions, each passage having an axis extending in said forward and rearward directions, and each passage having walls forming a narrowed passage section and walls forming a forwardly-facing passage shoulder at a front end of said narrowed passage section;

a plurality of contacts lying in said passages, each contact having a forward part with a rearwardly-facing contact shoulder abutting said passage shoulder, and each contact having a flange that lies rearward of said forward part and that lies in an interference fit with said narrowed passage section;

said flange has a periphery and has a plurality of notches in its periphery, with said notches being circumferentially spaced apart about said flange periphery, with said periphery having largely circular sections between said notches, with said largely circular sections curved about said axis and occupying at least 25% of the circumference of said periphery.

7. The connector described in claim 6 wherein:

said notches have circumferentially spaced side walls that extend primarily radially and a bottom wall that connects said side walls.

8. The connector described in claim 6 wherein:

said flange periphery is of cylindrical shape.

9. A connector comprising:

an insulator which has a plurality of cylindrical passages extending in forward and rearward directions, each passage having walls forming a narrowed passage section and a forwardly-facing passage shoulder at a front end of the narrowed passage section;

a plurality of contacts lying in said passages, each contact having a forward part with a rearwardly-facing contact shoulder abutting said passage shoulder, a rear flange that lies rearward of said forward part and that lies in an interference fit with said narrowed passage section, and a mid flange that lies between said forward part and said rear flange and that lies in an interference fit with said narrowed passage section;

each of said flanges having a tapered rear portion and a front end forming a forwardly-facing shoulder;

said rear flange has a smaller outside diameter than said mid flange;

said passage has an axis and has a rear wall at the rear of said narrowed passage section, with said rear wall having a radially inward part that is tapered to have a progressively larger diameter at progressively more rearward locations;

said rear flange has a forwardly-facing shoulder with a periphery that engages said radially inward part of said rear wall;

said rear flange has a cylindrical forward portion, and the periphery of said shoulder on said rear flange, forms a largely 90° angle with a sharp corner.

* * * * *